United States Patent [19]

Fox et al.

[11] 3,940,233

[45] Feb. 24, 1976

[54] CANDLE WICKING

[75] Inventors: Richard C. Fox, San Rafael; Thornton K. Jones, Greenbrae, both of Calif.

[73] Assignee: Chevron Research Company, San Francisco, Calif.

[22] Filed: Dec. 19, 1974

[21] Appl. No.: 534,521

[52] U.S. Cl. ..... 431/325; 44/7.5

[51] Int. Cl.[2] ..... F23D 3/18

[58] Field of Search ..... 431/288, 325, 289; 44/7.5

[56] References Cited

UNITED STATES PATENTS

| | | | |
|---|---|---|---|
| 984,029 | 2/1911 | Scheuble | 44/7.5 X |
| 3,428,409 | 2/1969 | Summers | 431/289 |
| 3,462,235 | 8/1969 | Summers | 431/289 |
| 3,560,122 | 2/1971 | Cassar | 431/288 |

*Primary Examiner*—William E. Wayner
*Assistant Examiner*—William E. Tapolcai
*Attorney, Agent, or Firm*—G. F. Magdeburger; C. J. Tonkin; J. T. Brooks

[57] ABSTRACT

A lead-free candle wick composition comprising a combustible wick and a stiffening agent is disclosed. The stiffening agent comprises a substantially wax-insoluble polymer or copolymer which has a Vicat softening point at least 2.5°C. higher than the melting point of the candle wax and which depolymerizes or pyrolyzes to substantially completely combustible products at a temperature above said melting point and at or below the temperature of the candle flame.

7 Claims, No Drawings

CANDLE WICKING

BACKGROUND OF THE INVENTION

Field of the Invention

A candle is simply a combustible, porous core or wick surrounded by a fusible, flammable solid, such as a wax or waxlike material. When the candle is lit, the heat from the flame melts the solid and the resulting liquid then flows up the wick by capillarity. This liquid is subsequently vaporized and becomes part of the innermost of three layers in the flame. The middle zone of the flame is where the vapor is partially decomposed, and the outer layer is marked by combustion of the vapor and the emission of carbon dioxide, water and other vapors into the atmosphere.

Candles, particularly those enclosed in plastic or glass containers, such as votive candles, generally require a stiffened wick. A limp wick may extinguish itself in the pool of liquid wax lying just below the flame of the burning wick. Another disadvantage of a limp wick in these types of candles is the possibility that while burning, the wick and flame could bend enough to make contact with the side of the container and cause breakage or other damage.

It is customary to stiffen the wicks of these kinds of candles by forming the wicks around a fine lead wire. When the wick is burned, the lead strand conveniently melts or vaporizes and leaves no undesirable residue to plug the porous wick and disrupt its capillary action. However, the lead vapors emitted into the atmosphere are toxic and may create a health hazard under certain conditions. As a result, an alternative, non-toxic stiffening agent for the wicks is desirable.

SUMMARY OF THE INVENTION

This invention provides stiffened candle wicks that will not impair the efficient burning of the candles in which they are implanted and will not emit a toxic or noxious odor when burned. Accordingly, there is provided a stiffened candle wick comprising a combustible wick and stiffening agent which comprises wax-insoluble polymer or copolymer having a Vicat softening point of at least 2.5°C. higher than the melting point of the candle wax, and depolymerizes or pyrolyzes to substantially completely combustible products at a temperature above said softening point and at or below the temperature of the candle flame.

DETAILED DESCRIPTION OF THE INVENTION

In accordance with the present invention, a stiffened candle wick composition comprising a combustible wick and a nonmetallic stiffening agent is provided.

The wicking utilized in this invention may be selected from a variety of materials. Not only must these materials be combustible, but they must also be porous enough to allow the required capillary action. Modifications of the wicking materials which do not affect the porousness may include such things as weaving or plaiting to assure clean burning or varying the diameter to effect proper consumption. The wicking material comprises approximately 80-90 weight percent of the stiffened candle wick composition. An excellent example is plaited cotton yarn of various sizes, weights and textures.

The wicking material used for the stiffened wicks of this invention may be treated with other chemicals as is customarily done with the leaded wicks. These chemicals have been found generally not to interfere with the embodiments of this invention. An example of such treatments would be the addition of a phosphorus compound to facilitate rapid extinction of the wicks and prevent smouldering.

The combustible and porous wicking may be surrounded by, and implanted in, any suitable fusible, flammable solid. These solids are customarily referred to as the "wax" of the candle. As herein employed, the term "wax" includes any wax or other wax-like material suitable for use in candles. These waxes are usually relatively readily easily volatilized and combustible. Some examples include beeswax, paraffins, stearines, carnuba wax, and montan wax, separately or in mixtures. Also suitable are mixtures of thermoplastic polyamide resins and flammable solvents such as disclosed in U.S. Pat. No. 3,819,342.

In order to maintain rigidity and to avoid drowning itself in the pool of liquid wax formed as the candle burns, the above-described wicking must be combined with a stiffening agent that is substantially wax-insoluble and whose softening point is above the temperature of the pool of molten wax. The wax of most votive candles has a melting point of approximately 50–70°C., and commonly 52–55°C. The Vicat softening point of the stiffener of this invention would accordingly be at least 2.5°C. higher than the temperatures within that range, or approximately at least 52.5–72.5°C. As an example, if the melting point of the wax were 52.5°C. or lower, polymethylmethacrylate would be an ideal stiffening agent, since it has a Vicat softening point of about 120°C. and is substantially waxinsoluble.

The capillary function of the wick must not be hindered by residues left from combustion. As the wax and wicking are substantially completely combustible, it is also desirable to have a stiffening agent that is substantially completely combustible between the above-defined softening point and the temperature of the candle flame.

Preferably the stiffening agent is a wax-insoluble polymer or copolymer which depolymerizes or pyrolyzes at a temperature above its softening point and at or below the temperature of the candle flame. Suitable polymers or copolymers are those which pyrolyze or depolymerize into combustible products in the above-defined range of temperatures. These products leave substantially no residue when burned thereafter within the same given range of temperatures.

Suitable wax-insoluble polymers or copolymers which have the above-specified softening points, depolymerization points and combustion properties generally have a molecular weight of approximately 1000 to 1,000,000, preferably 10,000 to 100,000, and generally contain only carbon, hydrogen, oxygen and nitrogen.

Monomeric units making up these suitable polymers include lower alkyl (preferably C1–C4) esters of acrylic acid and derivatives thereof such as methacrylic acid and aromatic alkenes having a total carbon content of 8–16 carbon atoms.

Examples of suitable polymers that depolymerize or pyrolyze within the temperature range specified, producing materials which are substantially completely combustible, are polymethylmethacrylate and polystyrene. The approximate Vicat softening point of polymethylmethacrylate is 120°C., of polyethylmethacrylate is 80°C., of polyisobutylmethacrylate is 68°C., of a mixture of poly(25% butyl, 75% isobutylmethacrylate)

is 60°C., of cellulose trinitrate is 68–81°C., and of polystyrene is approximately 115°C. The depolymerization temperature of polymethylmethacrylate is approximately 250°C. and that of polystyrene is approximately 325°C. The temperature of a candle flame is not exactly known, as it varies with the type of wax used and the conditions under which the candle is burned. However, the flame generally has a temperature in the range of 315–1000°C. Since both polymethyl-methacrylate and polystyrene have softening points and depolymerization points within the necessary ranges, these materials are excellently suited as stiffening agents in this invention.

Although not meant to be exhaustive or restrictive of the claims appended hereto, suitable examples of these polymers and copolymers include polyacrylates, polymethacrylates, polystyrenes, styrene-acrylate copolymers, styrene-methacrylate copolymers, nitrocellulose, and derivatives thereof. Some examples include polymethylmethacrylate, polyethylmethacrylate, polypropylmethacrylate, polybutylmethacrylate, polyisobutylmethacrylate, polystyrene, styrene-methyl-methacrylate copolymer, styrene-acrylate copolymer, and the like. Derivatives of naturally occuring polymers such as cellulose trinitrate are also suitable.

The stiffened candle wicks of this invention may be prepared by combining the wicking material and the stiffening agent in any suitable manner which provides stiffening without blocking the capillary flow of the melted wax in the wicking material. Generally, the stiffened candle wicks will comprise 75–95 weight percent of a wicking material and 5–25 weight percent stiffening agent. A preferred ratio is 80–90 weight percent wicking material and 10–20 weight percent stiffening agent.

In one method, the polymer is dissolved in a suitable solvent and the wicking material drawn through the solution to impregnate it with the polymer. After the wicking material is withdrawn from the solution, the solvent is removed by evaporation and a stiffened wick is obtained ready for use. Suitable solutions for use in this method comprise approximately 5–10% polymer and 90–95% solvent. Suitable solvents must be capable of dissolving the polymer and later being evaporated, leaving the polymer as a deposit in or on the wick. Preferably the solvents should vaporize without addition of substantial amounts of thermal energy. The particular solvent which can be used depends upon the particular polymer selected. The choice of solvents is not a matter of difficulty and will not be discussed except for a few illustrative examples.

For the polyacrylates and polymethacrylates commonly used suitable solvents include halogenated alkanes such as methylene chloride, chloroform, carbon tetrachloride, trichloroethane and ethers such as tetrahydrofuran. Examples for suitable solvents for polystyrene include benzene, styrene, and xylenes as well as the above-mentioned solvents.

In another method, the polymer can be applied to the wicking material in the form of an emulsion. In this method, emulsions of the polymer are prepared by emulsifying the monomer in water and adding an initiator to produce the emulsified polymer. These emulsions are easily prepared and also can be obtained commercially. In this method, the wicking material is impregnated with the polymer by drawing it through the emulsion, followed by heating to drive off the water and fuse the polymer to the surface of the wicking material.

In yet another method, a thread of the polymer can be inserted into the wicking material and used in the same manner as the lead wire is now used in lead-cored wicks. In this embodiment, the polymer thread should be of sufficient diameter to provide the necessary stiffening, but yet should not be so large that the wicking material becomes too stiff to handle easily or is subject to breakage.

The stiffened wicks which are prepared by surface treatment of the wicking material with a polymer solution or a polymer emulsion are soft and pliable enough that they can be wound on spools for easy shipment and handling. The stiffened wick containing the polymer thread likewise is pliable enough if the thread diameter is not too large to wind on a spool.

The following example is included to further illustrate the invention:

7 grams of polymethylmethacrylate are dissolved in 93 grams of trichloroethylene. A plaited-cotton wicking material is drawn through the solution at a rate of approximately 1 foot/sec. Following impregnation, the solvent is allowed to evaporate from the wicking material at room temperature, producing a stiffened wick not containing a lead core. The stiffened wick is then coated with wax and used to prepare a 100-hour votive candle.

The votive candle is prepared by filling a sanctuary-glass candle container with 7in. of white scale wax, 128/130 AMP. A section of the stiffened candle wick prepared above was inserted in the molten wax and the wax was allowed to solidify. After the wax had solidified, the candle was lighted and allowed to burn until completely consumed. The total burning time was approximately 100 hours. The stiffened wick was sufficiently stiff to allow the candle to burn properly throughout the entire burning time.

Votive candles prepared using wicks stiffened with polyisobutylmethacrylate, polyethylmethacrylate, polystyrene and cellulose trinitrate are found to burn satisfactorily and the wick is sufficiently stiff throughout the entire burning time.

What is claimed is:

1. A stiffened candle wick composition for use in a wax candle comprising a combustible wick and a stiffening agent comprising a substantially wax-insoluble polymer or copolymer having a Vicat softening point at least 2.5°C. higher than the melting point of the wax of said candle and which depolymerizes or pyrolyzes to substantially completely combustible products at a temperature above said softening point and not greater than the temperature of the flame of said candle when said candle is burned.

2. The composition of claim 1 wherein said wax-insoluble polymer is a polyacrylate or polyalkylacrylate.

3. The composition of claim 1 wherein said wax-insoluble polymer is a polymethacrylate.

4. The composition of claim 3 wherein said polymethacrylate is polymethylmethacrylate.

5. The composition of claim 1 wherein said wax-insoluble polymer is a polystyrene.

6. The composition of claim 1 wherein said wax-insoluble polymer is a nitrocellulose.

7. The composition of claim 1 wherein said stiffening agent comprises 10–20% weight of said stiffened candle wick composition.

* * * * *